US005339888A

United States Patent [19]

Tanner, Jr.

[11] Patent Number: 5,339,888

[45] Date of Patent: Aug. 23, 1994

[54] METHOD FOR OBTAINING NEAR NET SHAPE CASTINGS BY POST INJECTION FORMING OF WAX PATTERNS

[75] Inventor: Roy E. Tanner, Jr., Albuquerque, N. Mex.

[73] Assignee: General Electric Company, Cincinnati, Ohio

[21] Appl. No.: 91,947

[22] Filed: Jul. 15, 1993

[51] Int. Cl.[5] ..... B22C 9/04; B22C 7/02

[52] U.S. Cl. ..... 164/516; 164/45; 164/35

[58] Field of Search ..... 164/45, 34, 35, 516

[56] References Cited

U.S. PATENT DOCUMENTS

| | | | |
|---|---|---|---|
| 4,093,017 | 6/1978 | Miller, Jr. et al. | 164/28 |
| 4,133,371 | 1/1979 | Birch et al. | 164/350 |
| 4,421,153 | 12/1983 | Wilkinson et al. | 164/35 |
| 4,499,940 | 2/1985 | Hall | 164/36 |
| 4,673,549 | 6/1987 | Ecer | 419/10 |
| 4,724,891 | 2/1988 | Brookes | 164/122.1 |
| 4,728,258 | 3/1988 | Blazek et al. | 164/35 |
| 4,818,562 | 4/1989 | Arcella et al. | 427/53.1 |
| 4,919,193 | 4/1990 | Sasaki | 164/516 |
| 4,995,443 | 2/1991 | Easwaran | 164/34 |
| 5,000,894 | 3/1991 | LaRoche, Jr. | 264/59 |
| 5,014,763 | 5/1991 | Frank | 164/15 |
| 5,022,920 | 6/1991 | Buntrock et al. | 106/38.3 |
| 5,056,999 | 10/1991 | Lewis et al. | 425/150 |
| 5,072,770 | 12/1991 | Yodice | 164/34 |
| 5,176,188 | 1/1993 | Quinn et al. | 164/516 |

FOREIGN PATENT DOCUMENTS

| | | | |
|---|---|---|---|
| 57-75244 | 5/1982 | Japan | 164/45 |
| 63-286240 | 11/1988 | Japan | 164/45 |
| 63-62301 | 12/1988 | Japan | 164/45 |
| 3-207547 | 9/1991 | Japan | 164/45 |

OTHER PUBLICATIONS

*Howmet Expands Leadership Position in Single-Crystal Casting Technology;* Howmet Corporation.

*From Teeth to Jet Engines;* by Joseph L. Mallardi; Howmet Corporation.

*Primary Examiner*—Kuang Y. Lin

*Attorney, Agent, or Firm*—Jerome C. Squillaro; David L. Narciso

[57] ABSTRACT

The invention relates to a method of producing near net shaped metals parts from shaped wax patterns and more particularly a process whereby control of the wax pattern shape from which metal parts are to be investment cast is accomplished by machining the wax pattern after injection forming. The present invention incorporates a precision machining step whereby the injection formed wax is machined to dimensional values which more closely result in a near net shape of the cast metal part.

15 Claims, No Drawings

METHOD FOR OBTAINING NEAR NET SHAPE CASTINGS BY POST INJECTION FORMING OF WAX PATTERNS

FIELD OF INVENTION

The invention relates to a method of producing near net shaped metals parts from wax patterns and more particularly a process whereby wax patterns are machined to near net shape after injection forming.

BACKGROUND

The utilization of the lost wax technique to obtain shaped metal parts is well-known in the art. Wax patterns are formed by injection molding, assembled with risers and gatings and then subjected to a process which creates an inverse mold surrounding the wax pattern and includes: dipping in a slurry mixture, removal, dusting with refractory grains, and drying prior to reinsertion in the slurry mixture. The process is repeated until a suitable build-up of coating thickness has occurred that is stable at the high temperatures required to pour molten metal of an advanced nickel-based superalloy composition, such as R" N5. The mold configuration is heated to a low temperature to allow the wax to evaporate and then the hollow investment mold is heated to a higher temperature (>1800° F. ) to achieve a ceramic with good strength and handling properties. Molten metal is then poured into the mold cavities under various protective atmospheres, such as inert gas or vacuum as in the case of single crystal nickel based alloys.

The size and shape of the wax pattern is determined by factoring in the shrinkage rate of the wax which occurs during injection molding as well as the shrinkage rate of the metal being cast. These shrinkage factors are a function of the choice of both materials, i.e., wax and metal, at each step of the process, as well as the dimensional characteristics of the part being formed, such as the cross sectional thickness, part length, are length or part width, density of the material and overall uniformity of the part shape.

The wax pattern formed by injection molding is a replica of the final form of the metal part, however, it is typically oversized to allow for stock removal of approximately a minimum of 0.010 inch or about 10% overall before the final dimensional tolerances are obtained. Such oversizing is necessary because of the difficulties in controlling the process, for example, uneven wax solidification rates related to thickness variations of the pattern, slightly different liquid wax and injection mold temperatures both during and between runs, and other process repeatability problems. These factors frequently contribute to distortion of the wax pattern formed in the injection molding process which is thus compensated for by the 10% oversizing calculation. Prior art has focused on the need to control the size of the wax pattern and therefore, the resultant metal casting, by modifying the injection mold using various chills and other inserts to compensate for the liquid to solid shrinkage of the wax, altering the wax mold design used in the injection process, and changing the metal die shape used in the injection molder. These techniques have failed to produce metal castings with close dimensional tolerances.

An oversized wax pattern results in the replication of an oversized metal part which is undesirable for several reasons. The machining process is labor intensive, expensive and time-consuming and results in a higher than desired material scrap rate. Mismachining which results in scrapping of the metal part is very costly due to the material composition of the alloy and the type of casting process, generally directional solidification or single crystal. Raw material costs are higher since excess overstock results in an increased volume of machine turnings and chips. In addition, due to the uneven shrinkage rates for various sections of the part, extensive trials are required for new parts to determine the appropriate design of the metal die for the injection molder and structural features of the gating system which will produce an acceptable wax pattern shape.

Attainment of a wax pattern shape with close dimensional tolerances has remained a difficult problem, wherein the emphasis was on maintaining uniform temperature control of the wax and injection molder, and modifying the configuration to balance the wax solidification rate of thin and thick sections. As a result of these process limitations and the desired finished part dimensions including tight tolerances and complex design features, conventional oversizing of the wax pattern was considered necessary and attempts to obtain closer dimensional tolerances of the wax pattern were not successful.

SUMMARY

The present invention improves upon prior art's control of the wax pattern shape from which metal parts are to be investment cast by machining the wax pattern after injection forming. The present invention shifts the focus of shape control of the wax positive pattern from the wax injection molding operation to incorporation of a precision machining step of the wax pattern after injection molding whereby the formed wax pattern is machined to dimensional values which more closely result in a near net shape of the cast metal part.

An advantage of the present invention is that the machined wax allows the metal to be cast to extremely tight tolerances which consequently results in using less raw material in the subsequent metal casting operation and consequently requires less stock removal in the machining process. In addition, simpler, less complicated injection mold dies may be used in which the wax patterns are initially formed because tighter tolerances are not required at this juncture and will be achieved in the downstream machining operation of the wax pattern. This improvement eliminates the need to focus on the wax shrinkage patterns at the injection mold stage because the wax will be machined to closely meet part specification requirements afterwards.

The present invention has numerous advantages, including: less raw material lost due to machining; less machining time, and less chance of error while machining so that scrap rate is reduced. Further, since the emphasis to obtain near net shaped wax patterns has shifted away from controlling the wax pattern shape at the injection mold stage, less complicated dies for the injection molder are required. Set up is faster and easier, and distortion of the wax due to uneven solidification rates is no longer a concern.

DESCRIPTION OF THE INVENTION

In the present invention, near net shape casting of intricate metal parts is achieved by forming the wax patterns after the injection molding process and prior to the shell molding operation. In the injection molding process, a metal die is cut which has an inverse replication of the dimensions of the final part to be formed. This die is shaped to produce a wax positive pattern which is typically 10% material overstock of the basic shape. This overstock is required due to distortion of the wax during cooling which is the result of uneven cooling rates in various sections of the pattern. Individual wax patterns are then assembled to a gating system wherein molten metal will subsequently be poured into the shell mold. The wax assembly is dipped into a ceramic slurry mixture, removed and then dusted with dry coarse ceramic powder to expedite drying and assure that the shell will not spall or crack during a later heat treatment operation. Layers of ceramic are built up around the wax pattern in this manner until a suitable coating thickness is achieved which has the appropriate strength and handling properties to withstand the high temperature typically associated with molten metal such as an advanced nickel based superalloy composition. The shell mold is thoroughly dried and then heated (cured) in either an autoclave or flash fire operation to remove the wax. The mold is then preheated to a higher temperature and molten metal is cast into the hollow cavity under a protective atmosphere (inert gas) or vacuum (less than 1 micron) system. After the metal has solidified, the mold is destroyed and the metal castings are removed. The parts are separated from the gatings, deburred, and extensive precision machining is then required to achieve final dimensional tolerances of the part surfaces.

Traditionally, casting facilities have not had either the tools or equipment to produce precision finished parts. As a result, dimensional control of the wax pattern was attempted at the injection molding process. These attempts included machining the metal die used in the wax injection molding process to more closely replicate the final desired dimensions and so to reduce the amount of overstock on the wax positive pattern, but limitations with regard to the characteristics of the wax solidification rates between runs and uneven cooling between thin and thick sections in the same run were difficult to overcome. The present invention shifts the focus of achieving a wax pattern that resembles as close as possible a near net shape from the injection forming stage to shaping the wax pattern after injection molding. Machining of the wax after injection forming is performed by a final precision part manufacturer who is typically located at a facility remote from the casting facility. While this step interrupts process flow by removing the part from the casting facility and shipping it to another location for machining, the overall manufacturing benefits with regard to process yield of metal parts and the significant reduction in labor, machining and raw material costs greatly overcome the upstream costs associated with machining the wax and time lost in the process cycle. Note that the casting facility may also perform the precision machining operation of the wax molds if the appropriate equipment is available to achieve the dimensional tolerances required at this stage by the present invention.

Machining the wax pattern after injection forming results in the material overstock on the parts being reduced to less than 1 percent. Less material to be removed results in fewer machining errors which results in fewer damaged and rejected parts. Stock removal is less, so the depth of cut is shallower. The amount of machining relates to a superficial finishing operation as opposed to a deeper cut wherein a greater amount of stock is removed. Mismachining results when, for example, a tool bit, which is making such a deep cut, slips, gouges the part and results in the production of a scrapped part. As a result of the present invention, only a superficial amount of material is removed, tool life is extended due to less wear and severity of use resulting in lower tooling costs on a per part basis. In addition, the near net shaped metal part requires a shorter dwell time on the finishing machine and, in certain cases, requires no finish machining, resulting in significantly lower labor and machining costs and faster turn around time. Finally, the simplicity of the process and ease in machining of the wax lends this process to rapid implementation of design changes with minor expense in tooling changes and process down-time.

In addition; the present invention is more amenable toward achieving a near net shaped part as compared to prior art because the complexities related to the wax shrinkage rate are eliminated. The calculations with their associated standard deviations of error are no longer factored into the determination of the required oversized inverse die pattern of the injection molder and the resultant wax pattern. Since the wax pattern is machined to near net shape after injection forming, the emphasis on producing a wax pattern which is closer to the desired dimensional configuration at the injection molding stage is no longer necessary. The present invention greatly simplifies the mathematical formulations which are a function of shrinkage rate and statistical error associated with the calculations, since only the metal shrinkage rates are now taken into consideration, whereas, the prior art processes required consideration of both wax shrinkage rate and metal shrinkage rate. The ability to eliminate wax shrinkage rates results in the production of metal cast parts such as gas turbine shrouds in which the standard deviation from the desired tolerances is less than 0.002 inches, and an average tolerance of ±0.0015 inches is maintained, indicating that the parts formed by this process are highly reproducible and repeatable. The shrinkage rate calculation is now solely a function of metal solidification and the inherent features of the part being cast, such as the length, the cross-sectional thickness, arc length or width of the part, part density and overall uniformity of size and shape. Hardware which has been cast from machined wax has exhibited consistent dimensional stability, regardless of the intricate features of the part surfaces.

The present invention interrupts the standard process flow by removing the wax patterns after injection molding and closely machining them to a final dimensional shape prior to assembling into a gating system and then dipping into the slurry mixture. Dimensional accuracy of cast metal parts is achieved because the shell mold operation replicates inversely the near net wax positive pattern shape. Intricacies of the wax pattern such as grooves and slots in high pressure turbine shrouds were followed by the slurry mixture. For example, two hundred forty parts were cast in two lots. Dimensional tolerances for various sections were ±0.0015 inch. Standard deviation of these sections averaged 0.0005 inch with a range of less than or equal to 0.03 inch.

Machining time for a near net shaped metal part is significantly reduced because the overstock is approximately only 1% compared to the conventional casting method which results in a metal part that is 10% oversized. Machining the wax adds an operation to the process, however, this step is significantly easier, faster, simpler, and less costly than machining metal hardware after casting. The machined wax replicates near-final and final part dimensions taking into account the shrinkage factor associated with the metal solidification. After a ceramic shell mold has been built up around the wax patterns which has the required integrity and thickness to withstand subsequent heat treatments, the wax is removed by heating and an inverse mold remains which mirrors the final part dimensions. Metal parts cast from this mold require minimal metal removal, such as by surface grinding, to obtain finished quality hardware.

The present invention provides an inexpensive means to achieve near net shape and net shape metal parts by modification of the wax pattern shape prior to casting, but after injection molding. Since the depth of cut and amount of material to be removed per part is significantly lessened, all operations which support final precision machining are positively impacted. For example, the required machines and manpower required to support the yearly production of high pressure turbine shrouds at one facility can be reduced by 67 and 74 percent, respectively. Tooling costs for replacement fixtures on the various machines can be reduced by 86 percent because, in part, several grinding operations were eliminated. Finally, cycle time to process the parts was decreased by 80 percent. In all cases, these figures take into account the added work and cycle time associated with machining the wax.

It is understood that this process adds time to the early portion of the manufacturing cycle since the casting process must be interrupted and the wax patterns physically relocated to a machining area and then returned after machining for the shell molding operation at the casting area, but saves time at later portions of the cycle as a result of decreased machining. However, the present invention provides a unique solution to attainment of a near net shaped cast metal part by the utilization of a precision machining operation which is performed on the wax pattern after injection molding and prior to the shell molding operation. As note above, the subsequent downstream machining cycle time is substantially reduced since the parts require less material removal on the various surfaces resulting in a significant cost and time savings. For shrouds, 0.005 inches or less of material removal was required, as compared to up to 0.050 inches for critical dimensions in the prior art process.

EXAMPLE 1

High pressure turbine shrouds were processed according to the method detailed in the present invention. Conventionally, the shrouds were investment cast based on an oversized wax pattern design to compensate for non-uniform wax and metal shrinkage rates of the various sections of the shroud. An extensive lathe machining operation was performed on the cast metal shrouds in order to yield a dimensionally accurate part. As a result of the production of net and near net shaped shrouds by the method disclosed, almost all machining was eliminated and thus, the shrouds met dimensional tolerances in the as-cast state. The benefits of the present invention, in reducing cast weight and thereby most if not all machining, is best illustrated by the data presented in Table 1 which compares an identical shroud design cast using a conventional wax pattern and a formed wax pattern:

TABLE 1

Comparison of Identical Shroud Design Cast By the Conventional Method and According to the Present Invention

| Conventional Method (grams) | Net Shape Using Formed Wax Pattern (grams) |
|---|---|
| 224.46 | 118.54 |
| 224.40 | 116.44 |
| 223.97 | 119.57 |
| 222.45 | 115.23 |

Parts cast by the formed wax pattern method required no machining in order to meet dimensional tolerances. Parts cast by the conventional method required removal of approximately 48 percent stock before final dimensional drawing specifications were obtained.

A lot size for high pressure turbine shrouds for a large jet engine averages 42 parts. Production time to machine a lot of conventionally cast shrouds to meet dimensional tolerances was 13.104 labor-hours per lot. As a result of the net shape which was yielded by using the formed wax patterns in the casting process, total labor time for the identical part and lot size of 42 was reduced to one (1) labor-hour. This reflects a percent reduction of 92 percent in labor-hours.

Production cycle time refers to the length of time between when a part is received and is ready for release, during which time the appropriate work has been performed. Minimal turnaround time is desired to maintain efficiency and cost-effectiveness. A lot of high pressure turbine shrouds typically averaged a cycle time of 14 weeks, with a range of 10 to 25 weeks, based on the amount of machining and inspections required before the shrouds meet dimensional tolerances. Parts which were cast from the formed wax patterns had an average cycle time of one (1) week, since minimal or no machining was required. The as-cast parts were released after a quality control inspection. This dramatic reduction in as-cast part weight, final machining time, and short production cycle time clearly demonstrates the benefits of the present invention.

The present invention results in an easier, faster, simpler, less costly method to produce a wax pattern with near net shaped final dimensions. It represents a significant improvement over prior art in which a metal part formed by investment casting had 10% overstock and was machined to final dimensions. By machining the wax pattern to more closely replicate the final dimensions of the metal part, overstock is reduced to 1% and machining time and cost and scrap rates are reduced significantly. In some cases, it should be noted, net shape of the hardware was attained without need for any additional final machining. Therefore, the process as fully implemented has the capacity that produces, at best, repeatable precision finished metal parts as cast which meet drawing requirements and, at worst, cast metal parts that merely require a skim cut to achieve final dimensional tolerances.

Further, while R" N5 was utilized in the aforementioned example, the invention may be applicable for other nickel based alloys, such as MAR-M 509 and INCONEL. In addition, while directional solidification and single crystal casting processes were discussed above, the present invention is also appropriate for an equiaxed casting method.

While there has been described herein what is considered to be a preferred embodiment of the present invention, other modifications of the invention shall be apparent to those skilled in the art from the teachings herein and, it is therefore, desired to be secured in the appended claims all such modifications as fall within the true spirit and scope of the invention.

Accordingly, what is desired to be secured by Letters Patent of the United States is the invention as defined and differentiated in the appended claims.

What is claimed is:

1. A method for producing a hollow ceramic mold comprising the steps of:

(a) forming a wax pattern by injection molding; then (b) machining said wax pattern to a predetermined size; and (c) dipping said wax pattern in a slurry mixture to coat said wax pattern with said slurry mixture; then (d) removing said slurry coated wax pattern from said slurry mixture;

(e) allowing said slurry coated wax pattern to dry by evaporating the liquid; then (f) dipping said slurry coated wax pattern into said slurry mixture; then (g) removing said slurry coated wax pattern from said slurry mixture; then (h) allowing said slurry coated wax pattern to dry by evaporating the liquid;

(i) repeating the steps of (f), (g), and (h) until a predetermined thickness of said slurry coating on the wax pattern has been obtained; then (j) heating said slurry coated wax pattern to a temperature sufficient to remove said wax leaving a hollow, soft, unbonded ceramic mold; then (k) placing said hollow ceramic mold in a heating device and heating to a temperature sufficient to harden and bond said ceramic mold forming a hardened mold.

2. A method according to claim 1 wherein said hollow, unbonded ceramic mold is heated to a temperature above the liquefaction temperature of the wax to remove said wax from said hollow ceramic mold leaving a hollow cavity in said mold whereby the precise inverse impression of the wax pattern has allowed for the requisite shrinkage factor of the appropriate metal.

3. A method according to claim 1 wherein said hollow, unbonded ceramic mold is heated to a temperature sufficient to harden and bond said ceramic mold.

4. A method according to claim 1 wherein a plurality of said wax patterns are assembled with gatings, runners, and risers for joining as a single unit prior to dipping in said slurry mixture.

5. A method according to claim 1 wherein the steps of dipping said wax pattern into said slurry mixture and drying of said slurry mixture are performed at least six times.

6. A method according to claim 1 wherein a minimum thickness of said slurry mixture on said wax pattern is approximately one quarter inch.

7. A method for producing a cast metal part comprising the steps of:

(a) forming a wax pattern by injection molding; then (b) machining said wax pattern to a predetermined size; and (c) dipping said wax pattern in a slurry mixture to coat said wax pattern with said slurry mixture; then (d) removing said slurry coated wax pattern from said slurry mixture;

(e) allowing said slurry coated wax pattern to dry by evaporating the liquid; then (f) dipping said slurry coated wax pattern into said slurry mixture; then (g) removing said slurry coated wax pattern from said slurry mixture; then (h) allowing said slurry coated wax pattern to dry by evaporating the liquid;

(i) repeating the steps of (f), (g), and (h) until a predetermined thickness of said slurry coating on the wax pattern has been obtained; then (j) heating said slurry coated wax pattern to a temperature sufficient to remove said wax leaving a hollow, soft, unbonded ceramic mold; then (k) placing said hollow ceramic mold in a heating device and heating to a temperature sufficient to harden and bond said ceramic mold forming a hardened ceramic mold; and (l) pouring molten metal into said hardened hollow ceramic mold to form a metal part which requires minimal final machining to obtain dimensional tolerances of part surfaces.

8. A method according to claim 7 wherein said metal part is a single crystal formed by controlled heat withdrawal.

9. A method according to Claim 7 wherein said molten metal is poured under a protective atmosphere.

10. A method according to claim 9 wherein said protective atmosphere is an inert gas.

11. A method according to claim 9 wherein said protective atmosphere is a vacuum of less than one micron.

12. A method according to claim 7 wherein said final machining to remove excess metal requires removal of about 0.002 inch or less of metal from the cast surface to achieve a part having the required dimensional configuration.

13. A method for producing a cast metal part comprising the steps of:

(a) forming a wax pattern by injection molding; then (b) machining said wax pattern to a predetermined size; and (c) dipping said wax pattern in a slurry mixture to coat said wax pattern with said slurry mixture; then (d) removing said slurry coated wax pattern from said slurry mixture;

(e) allowing said slurry coated wax pattern to dry by evaporating the liquid; then (f) dipping said slurry coated wax pattern into said slurry mixture; then (g) removing said slurry coated wax pattern from said slurry mixture; then (h) allowing said slurry coated wax pattern to dry by evaporating the liquid;

(i) repeating the steps of (f), (g), and (h) until a predetermined thickness of said slurry coating on the wax pattern has been obtained; then (j) heating said slurry coated wax pattern to a temperature sufficient to remove said wax leaving a hollow, soft, unbonded ceramic mold; then (k) placing said hollow ceramic mold in a heating device and heating to a temperature sufficient to harden and bond said ceramic mold forming a hardened ceramic mold; and (l) pouring molten metal into said hardened hollow ceramic mold to form a metal part which requires no final machining to obtain dimensional tolerances of part surfaces.

14. A method for producing, a cast high pressure turbine shroud comprising the steps of:

(a) forming a wax pattern by injection molding; then (b) machining said wax pattern to a predetermined size; and (c) dipping, said wax pattern in a slurry mixture to coat said wax pattern with said slurry mixture; then (d) removing said slurry coated wax pattern from said slurry mixture;

(e) allowing said slurry coated wax pattern to dry by evaporating the liquid; then (f) dipping said slurry coated wax pattern into said slurry mixture; then (g) removing said slurry coated wax pattern from said slurry mixture; then (h) allowing said slurry coated wax pattern to dry by evaporating the liquid;

(i) repeating the steps of (f), (g), and (h) until a predetermined thickness of said slurry coating on the wax pattern has been obtained; then (j) heating said slurry coated wax pattern to a temperature sufficient to remove said wax leaving a hollow, soft, unbonded ceramic mold; then (k) placing said hollow ceramic mold in a heating device and heating to a temperature sufficient to harden and bond said ceramic mold forming a hardened ceramic mold; and (l) pouring molten metal into said hardened hollow ceramic mold to form a metal part which requires minimal final machining to obtain dimensional tolerances of part surfaces.

15. A method for producing a cast high pressure turbine shroud comprising the steps of:

(a) forming a wax pattern by injection molding; then (b) machining said wax pattern to a predetermined size; and (c) dipping said wax pattern in a slurry mixture to coat said wax pattern with said slurry mixture; then (d) removing said slurry coated wax pattern from said slurry mixture;

(e) allowing said slurry coated wax pattern to dry by evaporating the liquid; then (f) dipping said slurry coated wax pattern into said slurry mixture; then (g) removing said slurry coated wax pattern from said slurry mixture; then (h) allowing said slurry coated wax pattern to dry by evaporating the liquid;

(i) repeating the steps of (f), (g), and (h) until a predetermined thickness of said slurry coating on the wax pattern has been obtained; then (j) heating said slurry coated wax pattern to a temperature sufficient to remove said wax leaving a hollow, soft, unbonded ceramic mold; then (k) placing said hollow ceramic mold in a heating device and heating to a temperature sufficient to harden and bond said ceramic mold forming a hardened ceramic mold; and (l) pouring molten metal into said hardened hollow ceramic mold to form a metal part which requires no final machining to obtain dimensional tolerances of part surfaces.

* * * * *